US005140903A

United States Patent [19]

Terauchi

[11] Patent Number: 5,140,903

[45] Date of Patent: Aug. 25, 1992

[54] WOBBLE PLATE TYPE COMPRESSOR

[75] Inventor: Kiyoshi Terauchi, Isesaki, Japan

[73] Assignee: Sanden Corporation, Gunma, Japan

[21] Appl. No.: 683,044

[22] Filed: Apr. 10, 1991

[30] Foreign Application Priority Data

Apr. 10, 1990 [JP] Japan ..... 2-93123

[51] Int. Cl.[5] ..... F01B 3/00; F01B 13/04

[52] U.S. Cl. ..... 92/12.2; 92/71; 417/222.2

[58] Field of Search ..... 92/12.2, 57, 71; 91/499, 500, 505, 506; 417/269, 222 S; 60/487

[56] References Cited

U.S. PATENT DOCUMENTS

| | | | |
|---|---|---|---|
| 4,011,029 | 3/1977 | Shimizu | 417/269 |
| 4,776,259 | 10/1988 | Takai | 417/269 |
| 4,782,739 | 11/1988 | Saito | 92/71 |
| 4,842,488 | 6/1989 | Terauchi | 417/269 |
| 4,875,834 | 10/1989 | Higuchi et al. | 417/269 |
| 4,880,360 | 11/1989 | Terauchi et al. | 417/369 |
| 4,960,367 | 10/1990 | Terauchi | 417/222 S |
| 4,979,877 | 12/1990 | Shimizu | 92/71 |
| 5,015,154 | 5/1991 | Higuchi et al. | 417/222 S |

*Primary Examiner*—Edward K. Look
*Assistant Examiner*—Hoang Nguyen
*Attorney, Agent, or Firm*—Banner, Birch, McKie & Beckett

[57] ABSTRACT

This invention is directed to a wobble plate type refrigerant compressor. The compressor includes a housing having a cylinder block provided with a plurality of peripherally located cylinders, a front end plate and a crank chamber enclosed by the front end plate and the cylinder block. A piston is slidably fitted within each of the cylinders. A drive shaft is connected to a rotor which is connected to a slant plate. A wobble plate is disposed on an inclined surface of the slant plate. A connecting rod connects the wobble plate within each of pistons. Each end of the connecting rod is coupled to the wobble plate and the piston by a ball-and-socket joint, respectively. The ball-and-socket joints provided at the wobble plate are peripherally located. A rotation preventing device for preventing rotation of the wobble plate includes a fork-shaped slider attached to an outer peripheral end of the wobble plate and a sliding rail held between the cylinder block and the front end plate. The center of the ball-and-socket joints provided at the wobble plate are radially shifted in the rotational direction of the cam rotor with respect to the center of ball-and-socket joints provided at each of the pistons by a predetermined angle; thereby preventing a cyclic collision between the fork-shaped slider and the sliding rail when the cam rotor rotates.

20 Claims, 6 Drawing Sheets

WOBBLE PLATE TYPE COMPRESSOR

BACKGROUND OF THE INVENTION

I. Technical Field

The present invention relates to a refrigerant compressor, and more particularly, to a wobble plate type compressor for use in an automative air conditioning system.

II. Description of the Prior Art

FIG. 1 illustrates a general construction of a wobble plate type refrigerant compressor with a variable displacement mechanism for use in an automotive air conditioning system. With reference to FIG. 1, compressor 10 includes cylindrical housing assembly 20 including cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward (to the left in FIG. 1) of crank chamber 22 by a plurality of bolts 101. Rear end plate 24 is mounted on cylinder block 21 at its opposite end by a plurality of bolts 102. Valve plate 25 is located between rear end plate 24 and cylinder block 21. Opening 231 is centrally formed in front end plate 23 for supporting drive shaft 26 by bearing 30 disposed in the opening. The inner end portion of drive shaft 26 is rotatably supported by bearing 31 disposed within central bore 210 of cylinder block 21. Bore 210 extends to a rearward end surface of cylinder block 21 to dispose valve control mechanism 19 which comprises crank pressure responsive bellows 193 and discharge pressure responsive rod 195. Valve control mechanism 19 controls the opening and closing of communication path 150, which is formed in cylinder block 21 and later-mentioned valve plate assembly 200 in order to provide communication between crank chamber 22 and suction chamber 241. Further details of valve control mechanism 19 and the component parts associated therewith are disclosed in U.S. Pat. No. 4,960,367 to Terauchi, a detailed explanation thereof is therefore omitted.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to the longutudinal axis of drive shaft 26.

Wobble plate 60 is rotatably mounted on slant plate 50 through bearings 61 and 62. Rotation preventing device 610 includes fork-shaped slider 611 attached to the outer peripheral end of wobble plate 60 and sliding rail 612 which is held between front end plate 23 and cylinder block 21. Fork-shaped slider 611 is slidably mounted on sliding rail 612. Rotation preventing device 610 prevents rotation of wobble plate 60, thereby allowing wobble plate 60 to nutate when cam rotor 40 rotates. Further details of rotation preventing device 610 are disclosed in U.S. Pat. No. 4,875,834 to Higuchi et al., therefore, a detailed explanation thereof is omitted.

Cylinder block 21 includes a plurality of (for example, seven) identical axial cylinders 70 formed therein, in which identical pistons 71 are slidably and closely fitted. Each piston 71 is connected to wobble plate 60 through piston rod 72. Ball **72*a* at one end of rod 72 is firmly received in socket 711 of piston 71 by caulking an edge of socket 711, and ball 72*b* at the other end of rod 72 is firmly received in socket 601 of wobble plate 60 by caulking an edge of socket 601. But, balls 72*a* and 72*b* are slidable along an inner spherical surface of sockets 711 and 601 respectively. The center of the ball-and-socket joint of piston 71 is located on the longitudinal axis of cylinder 70. It should be understood that, although only one ball-and-socket joint is illustrated in the drawing, there are a plurality of sockets peripherally arranged around wobble plate 60 to receive the balls of various rods 72, and that each piston 71 is formed with a socket for receiving the other balls of rods 72**.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. In order to maintain an effective seal between cylinder block 21 and valve plate 25, suction ports 242 and discharge ports 252 are provided with suitable reed valves, as described in detail in U.S. Pat. No. 4,011,029 to Shimizu.

Suction chamber 241 further includes inlet portion **241*a* which is connected to an evaporator (not shown) of an external cooling circuit. Discharge chamber 251 is provided with outlet portion 251*a* connected to a condenser (not shown) of the cooling circuit. Gaskets 27 and 28 are located between cylinder block 21 and the inner surfaces of valve plate 25 and rear end plate 24, respectively, to thereby seal the mating surfaces of cylinder block 21, valve plate 25 and rear end plate 24. Gaskets 27 and 28 and valve plate 25 thus form valve plate assembly 200**.

FIG. 2 schematically illustrates a vertical transverse sectional view of a wobble plate type refrigerant compressor in accordance with one embodiment of the prior art, like numerals denoting corresponding elements to those shown in FIG. 1. The locational relationship between the ball-and-socket joints provided at wobble plate 60 and the ball-and-socket joints provided at each of respective pistons 71 is specifically illustrated.

With reference to FIG. 2, points $P'_1$–$P'_7$ represent the center of the ball-and-socket joints of seven identical pistons 71, respectively and points $W'_1$–$W'_7$ represent the center of the ball-and-socket joints of wobble plate 60, respectively.

A plurality of (for example, seven) cylinders 70 are peripherally located in cylinder block 21 about the longitudinal axis of drive shaft 26 with an equiangular interval. Therefore, points $P'_1$–$P'_7$ are peripherally located about the longitudinal axis of drive shaft 26 with an equiangular interval. Similarly, points $W'_1$–$W'_7$ are peripherally located about the longitudinal axis of wobble plate 60 with an equiangular interval. Points $W'_1$–$W'_7$ are located on first circle $C'_1$, and points $P'_1$–$P'_7$ are located on second circle $C'_2$.

FIG. 2 specifically illustrates a situation in which a plane surface including first circle $C'_1$ is positioned so as to be parallel with a plane surface including second circle $C'_2$. Therefore, first and second circles $C'_1$ and $C'_2$ are concentric with respect to a point "O" through which the longitudinal axes of both drive shaft 26 and wobble plate 60 pass. As illustrated, the radius of circle $C'_1$ is greater than the radius of circle $C'_2$.

In the assembling process of the compressor, points $W'_1$–$W'_7$ are positioned so as to be radially aligned with points $P'_1$–$P'_7$, respectively, when fork-shaped slider 611 is mounted on sliding rail 612. As illustrated in FIG. 2, a center axis passes through point "O", the radially aligned points $W'_1$and $P'_1$, and the center of rotation prevention means 610 which is aligned therewith.

In general, if an ideal rotation preventing device is utilized in the compressor, the wobble plate nutates with uniform angular velocity about the longitudinal axis thereof when a cam rotor rotates. Therefore, when a cam rotor rotates, every location of the wobble plate simultaneously traces both an axially elongated figure eight if viewed in the radial direction and a circular figure if viewed in the axial direction.

However, when the compressor illustrated in FIG. 2 operates, wobble plate 60 nutates with a non-uniform angular velocity about the longitudinal axis thereof when cam rotor 40 rotates. Because rotation preventing device 610 is less than ideal, it does not allow wobble plate 60 to nutate with uniform angular velocity about the longitudinal axis thereof. Therefore, wobble plate 60 nutates with an angular acceleration. Accordingly, there is a torque acting on wobble plate 60 which tends to rotate it in the rotational direction "A" of cam rotor 40. The torque is the product of the angular acceleration and the moment of inertia of wobble plate 60 when cam rotor 40 rotates. Therefore, the value of the torque cyclically varies with the rotation of cam rotor 40 as shown by the graphical representation in FIG. 8. In the graph, the period of the cycle is given by the fraction $2\pi/7$. The denominator of the fraction $2\pi/7$ is the number of cylinders 70 in the compressor. When the differential "H" between the maximum and minimum values of the torque exceeds a certain value, a backlash between slider 611 and rail 612 is thereby created. Therefore, collisions between one inner plane side surface 611*a* of slider 611 and one outer plane side surface 612*a* of rail 612, and the other inner plane side surface 611*b* of slider 611 and the other outer plane side surface 612*b* of rail 612 are cyclically repeated when cam rotor 40 rotates. This cyclic collision impacts upon wobble plate 60 and rotation preventing device 610, thereby causing damage thereto. Furthermore, the cyclic collision generates a cyclic contact noise which is conducted to a passenger compartment of an automobile and thereby produces an offensive noise to the passengers.

FIG. 3 schematically illustrates a transverse vertical sectional view of a wobble plate type refrigerant compressor in accordance with another embodiment of the prior art, like numerals representing corresponding elements to those shown in FIG. 1. In the drawing, a locational relationship between the ball-and-socket joints provided at wobble plate 60 and the ball-and-socket joints provided at each of respective pistons 71 is specifically illustrated.

In this prior art embodiment, a plurality of (for example, seven) identical axial cylinders 701–707 are peripherally located about the longitudinal axis of drive shaft 26. The longitudinal axes of respective cylinders 701–707 are represented by points $P'_{11}$–$P'_{17}$ which are located at the center of the ball-and-socket joints of identical seven pistons 711–717, respectively. Points $W'_{11}$–$W'_{17}$ are peripherally located about the longitudinal axis of wobble plate 60 with an equiangular interval, as in the prior art embodiment of FIG. 2. Points $W'_{11}$–$W'_{17}$ are located at the center of the respective ball-and-socket joints of wobble plate 60, and are located on first circle $C_1$. Points $P'_{11}$–$P'_{17}$ are located on second circle $C'_2$. Point $P'_{14}$, point $P'$15, and point "O" through which the longitudinal axis of cam rotor 40 passes. define a small sector and a remaining larger sector. The larger sector is equally divided into six identical sectors having arcs $P'_{11}$ to $P'_{12}$, $P'_{12}$ to $P'_{13}$, $P'_{13}$ to $P'_{14}$, $P'_{15}$ to $P'_{16}$, $P'_{16}$ to $P'_{17}$, and $P'_{17}$ to $P'_{11}$, respectively. The arc length, and thus the corresponding angle, of the small sector is designed to be slightly greater than the arc of each of the six identical sectors in order to provide adequate space for sliding rail 612 of rotation preventing device 610 to be located between pistons 714 and 715.

FIG. 3 specifically illustrates a situation in which a plane surface including first circle $C_1$ is positioned so as to be parallel with a plane surface including second circle $C'_2$, as in the embodiment of FIG. 2. Therefore, first and second circles $C_1$ and $C'_2$ are concentric with respect to point "O" through which the longitudinal axes of both cam rotor 40 and wobble plate 60 pass. As illustrated the radius of circle $C_1$ is greater than the radius of circle $C'_2$.

In the assembling process of the compressor, point $W'_{11}$ is positioned so as to be radially aligned with points $P'_{11}$ when fork-shaped slider 611 is mounted on sliding rail 612. Accordingly, points $P'_{12}$–$P'_{14}$ are symmetrical with points $P'_{17}$–$P'_{15}$, respectively, with respect to the line which passes through points "O", $P'_{11}$ and $W'_{11}$. Therefore, the angular position of points $W'_{12}$–$W'_{14}$ about point "O" are shifted in the rotational direction "A" of cam rotor 40 with respect to points $P'_{12}$–$P'_{14}$, respectively; and the angular position of points $W'_{17}$–$W'_{15}$ about point "O" are shifted in the opposite rotational direction of cam rotor 40 with respect to points $P'_{17}$–$P'_{15}$, respectively. The amount of angular shift of respective points $W'_{12}$–$W'_{14}$ about point "O" from respective points $P'_{12}$–$P'_{14}$ in the rotational direction "A" of cam rotor 40 is gradually increased from point $W'_{12}$ to point $W'_{14}$. The amount of angular shift of respective points $W'_{17}$–$W'_{15}$ about point "O" from respective points $P'_{17}$–$P'_{15}$ in the opposite rotational direction of cam rotor 40 is gradually increased from point $W'_{17}$ to point $W'_{15}$.

When the compressor illustrated in FIG. 3 operates, wobble plate 60 behaves in the same manner as described in the prior art embodiment of FIG. 2, thereby causing the same defects as described therefor.

SUMMARY OF THE INVENTION

Accordingly, it is an object of the present invention is to provide a wobble plate type compressor in which rotation of a wobble plate is prevented without generating a cyclic collision between a fork-shaped slider and a sliding rail of a rotation preventing device of the wobble plate.

The wobble plate type compressor comprises a housing having a cylinder block provided with a plurality of cylinders and a crank chamber adjacent the cylinder block. A piston is slidably fitted within each of the cylinders. A drive shaft is rotatably supported in the housing. A rotor is fixed on the drive shaft and further connected to an inclined plate, such as a slant plate. A wobble plate is disposed on an inclined surface of the slant plate.

A coupling member, such as a connecting rod couples the wobble plate with each of the plurality of pistons. The connecting rod includes one ball-shaped end which is coupled with the wobble plate by a ball-and-socket joint and another ball-shaped end which is coupled with each of the pistons by a ball-and-socket joint. Rotational motion of the slant plat is converted into nutational motion of the wobble plate by means of a rotation preventing device which prevents rotation of the wobble plate when the rotor rotates. The rotation preventing device includes a sliding rail axially extending within the crank chamber and a fork-shaped slider attached to an outer peripheral end of the wobble plate and slidably mounted on the sliding rail.

The centers of one of the ball-shaped ends of the plurality of connecting rods are radially shifted by a predetermined angle in the rotational direction of the cam rotor with respect to the centers of the other ball-shaped ends of the plurality of connecting rods.

DETAILED DESCRIPTION OF THE PREFERRED EMBODIMENTS

Figure 1:
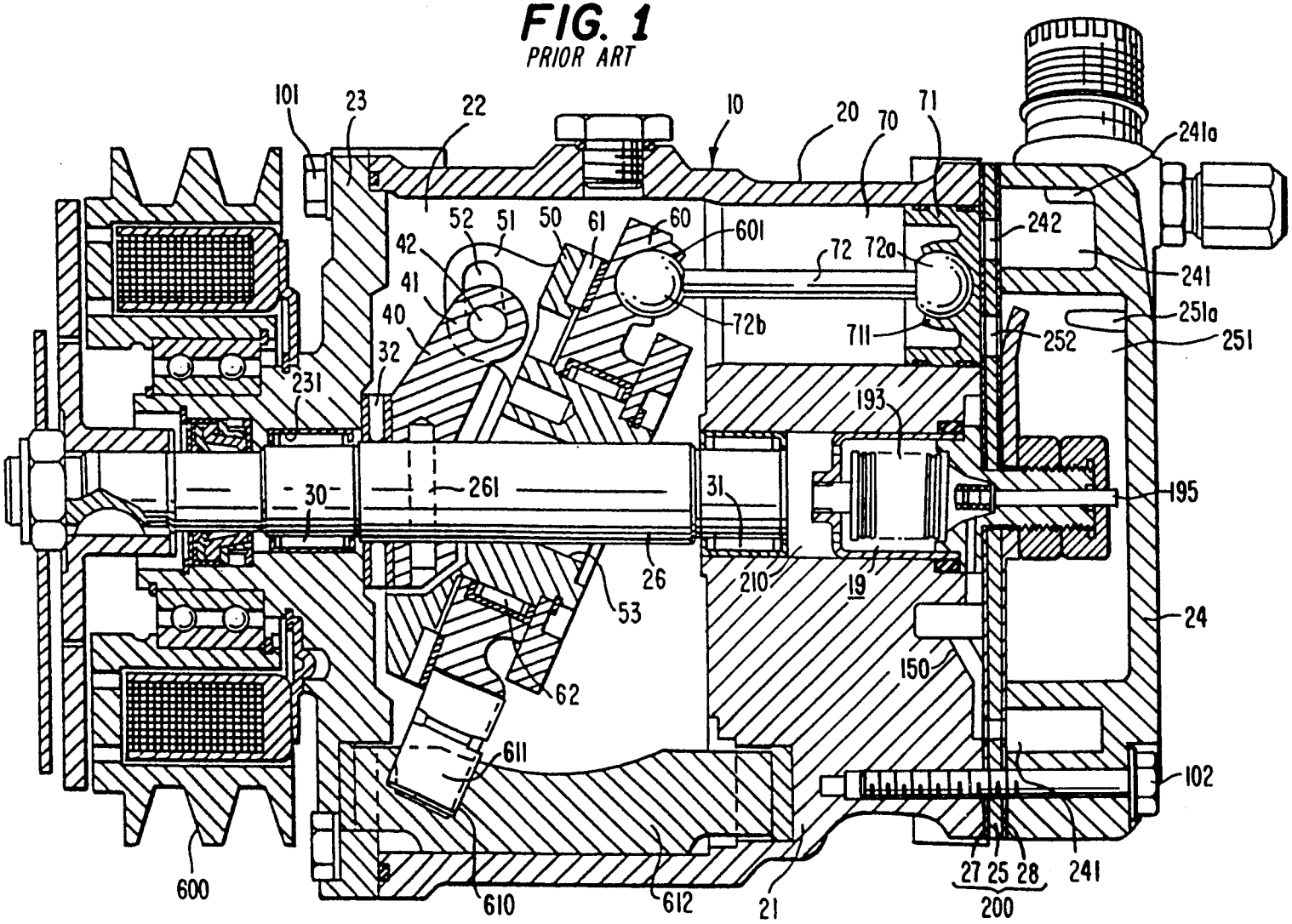
FIG. 1 PRIOR ART
FIG. 1 illustrates a vertical longitudinal sectional view of a wobble plate type refrigerant compressor with a variable displacement mechanism in accordance with the prior art.
Figure 2:
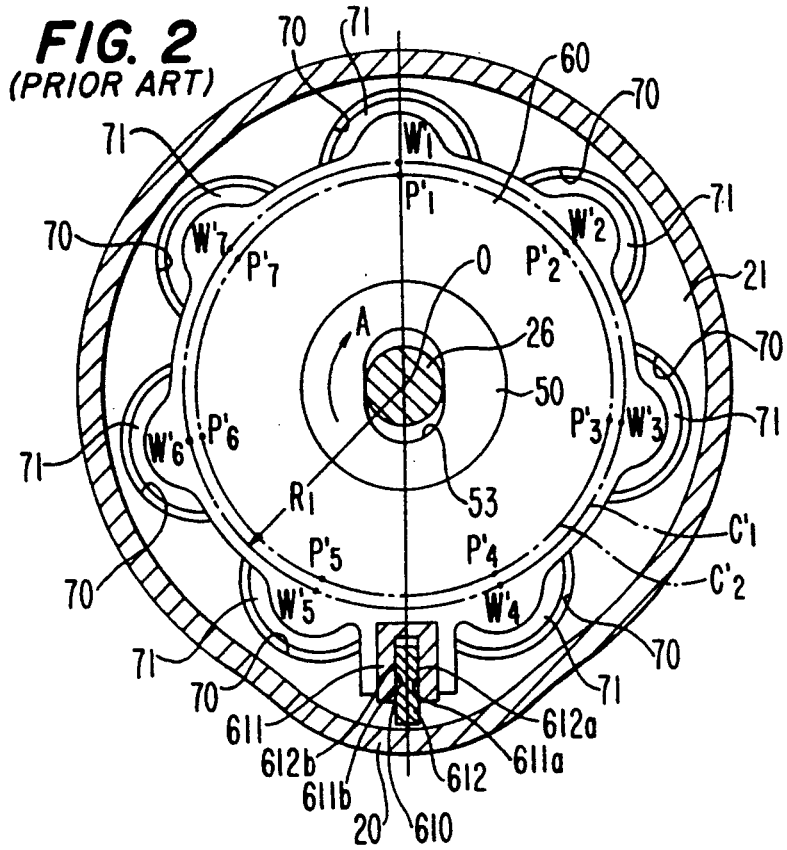
FIG. 2 (PRIOR ART)
FIG. 2 schematically illustrates a vertical transverse sectional view of a wobble plate type refrigerant compressor in accordance with one prior art embodiment. In the drawing, a locational relationship between the ball-and-socket joints provided at a wobble plate and the ball-and-socket joints provided at each of the respective pistons is specifically illustrated.
Figure 4:
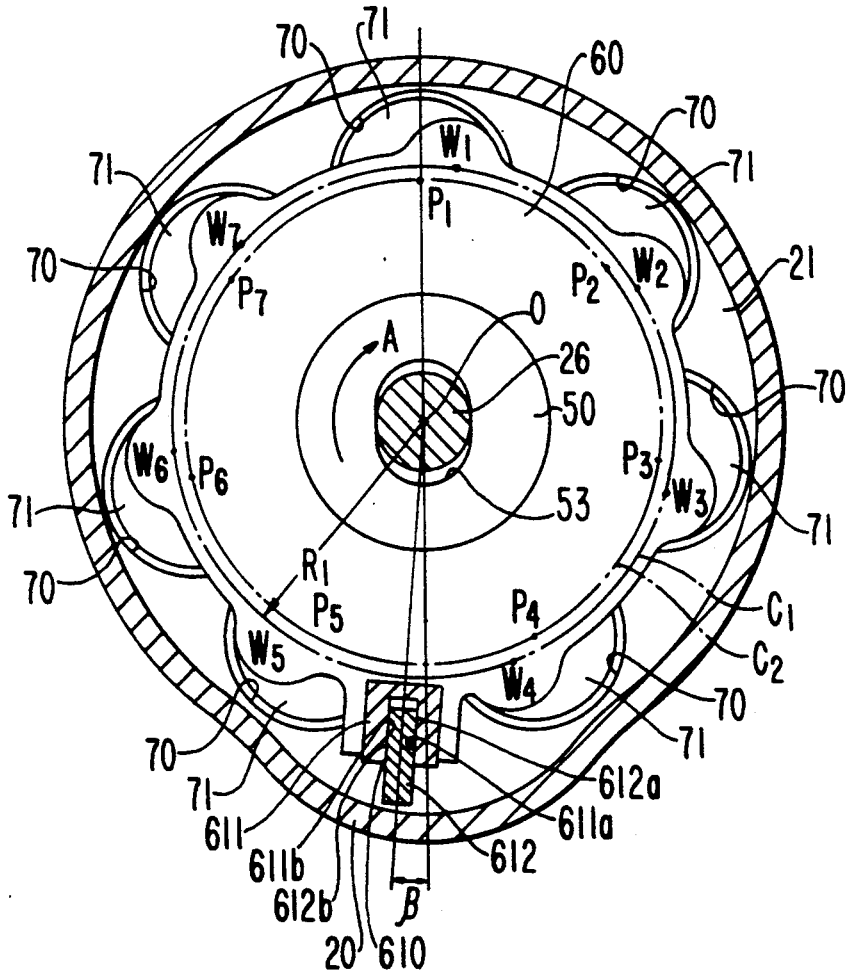
FIG. 4 schematically illustrates a vertical transverse sectional view of a wobble plate type refrigerant compressor in accordance with a first embodiment of the present invention. In the drawing, a locational relationship between the ball-and-socket joints provided at a wobble plate and the ball-and-socket joints provided at each of the respective pistons is specifically illustrated.

With reference to FIG. 4, a first embodiment of the present invention is applied to the prior art embodiment of FIG. 2, with like numerals representing corresponding elements as shown in FIGS. 1 and 2. Points $P_1$–$P_7$ represent the centers of the ball-and-socket joints of seven identical pistons 71, respectively, and points $W_1$–$W_7$ represent the centers of each of the ball-and-socket joints of wobble plate 60, respectively.

A plurality of (for example, seven) cylinders 70 are peripherally located about the longitudinal axis of drive shaft 26 with an equiangular interval, as described for FIG. 2. Therefore, point $P_1$–$P_7$ are peripherally located about the longitudinal axis of drive shaft 26 with an equiangular interval. Furthermore, points $W_1$–$W_7$ are peripherally located about the longitudinal axis of wobble plate 60 with an equiangular interval, as in the prior art embodiment shown in FIG. 2. Points $W_1$–$W_7$ are located on first circle $C_1$ and points $P_1$–$P_7$ are located on second circle $C_2$.

FIG. 4 specifically illustrates a situation in which a plane surface including first circle $C_1$ is positioned so as to be parallel with a plane surface including second circle $C_2$, as was the case in FIG. 2.

However, in the first embodiment of the present invention, sliding rail 612 is positioned so as to be radially shifted by angle $\beta$ in the rotational direction "A" of cam rotor 40 with respect to the location at which sliding rail 612 was positioned in the prior art embodiment of FIG. 2. That is, sliding rail 612 is radially shifted with respect to the center axis passing through radially aligned points $W'_1$ and $P'_1$ and the center of rotation prevention means 610 when it is aligned therewith, as shown in FIG. 2. Therefore, in the assembling process of the compressor, points $W_1$–$W_7$ are radially shifted in the rotational direction "A" of cam rotor 40 with respect to points $P_1$–$P_7$, respectively, by an angle $\beta$, (for example, $\pi/60$) when fork-shaped slider 611 is mounted on sliding rail 612. As a result, when the compressor operates, a torque which tends to rotate wobble plate 60 in rotational direction "A" of cam rotor 40 is generated.

Figure 5:
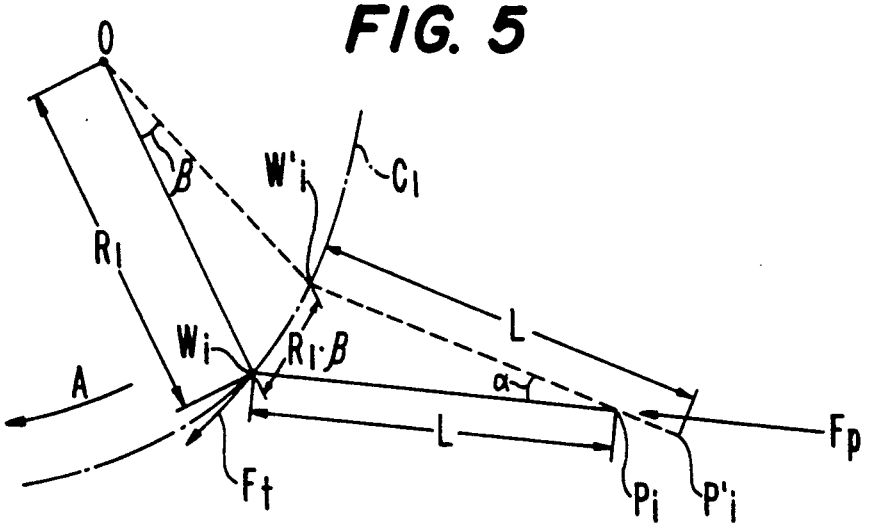
FIG. 5 illustrates a dynamic schematic of the present invention.

A dynamic analysis with respect to the first embodiment of the present invention is described below. With reference to FIG. 5, force $F_t$ is a component force of gas pressure reaction force $F_p$ which acts on piston 71. Component force $F_t$, as given by equation (1), acts on point $W_i$ along the tangent at point Wi on first circle $C_1$.

$$F_t=(F_p)(\tan\alpha) \quad (1)$$

In equation (1), angle $\alpha$ (alpha) is the angle between the line including points $P'_i$ and $W'_i$ and the line including points $P_i$ and $W_i$. Since $\alpha$ is small, tan $\alpha$ can be approximately substituted for by $(R_1)(\beta)/(L)$. In this term, "$R_1$" is the radius of first circle $C_1$. Angle $\beta$ is the angle between the line including points "O" through which the longitudinal axis of wobble plate 60 passes and $W'_i$, and the line including points "O" and $W_i$. "L" is the distance between points $P_i$ and $W'_i$, that is, $P'_i$ and $W'_i$. Therefore, equation (1) is transformed into equation (2).

$$F_t=(F_p)(R_1)(\beta)/L \quad (2)$$

Accordingly, the torque $\tau$ which tends to rotate wobble plate 60 in rotational direction "A" of cam rotor 40 in shown by equation (3).

$$\tau=(F_i)(R_1) \quad (3)$$

By using equation (2), equation (3) is transformed into equation (4).

$$\tau=(F_p)(R_1^2)(\beta)/L \quad (4)$$

Figure 8:
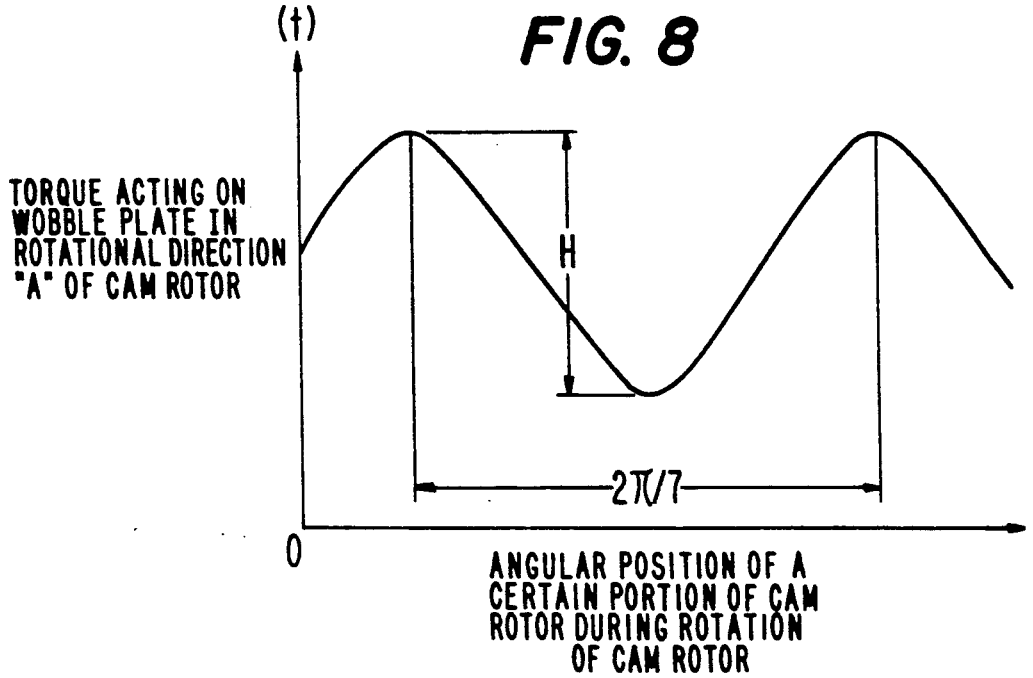
FIG. 8 is a graphical representation of the variance in the torque acting upon a wobble plate which occurs during the rotation of a cam rotor in a wobble plate type refrigerant compressor.

In this embodiment, by appropriately specifying angle $\beta$, the magnitude of torque $\tau$ can be designed to maintain one inner plane side surface 611*a* of slider 611 in contact with one outer plane side surface 612*a* of rail 612 when cam rotor 40 rotates even though differential "H" exceeds the certain value, as discussed above with reference to FIG. 8. Therefore, the cyclic collision between slider 611 and rail 612 can be eliminated, thereby preventing damage to wobble plate 60 and rotation preventing device 610 and eliminating the offensive cyclic contact noise between slider 611 and rail 612.

Figure 3:
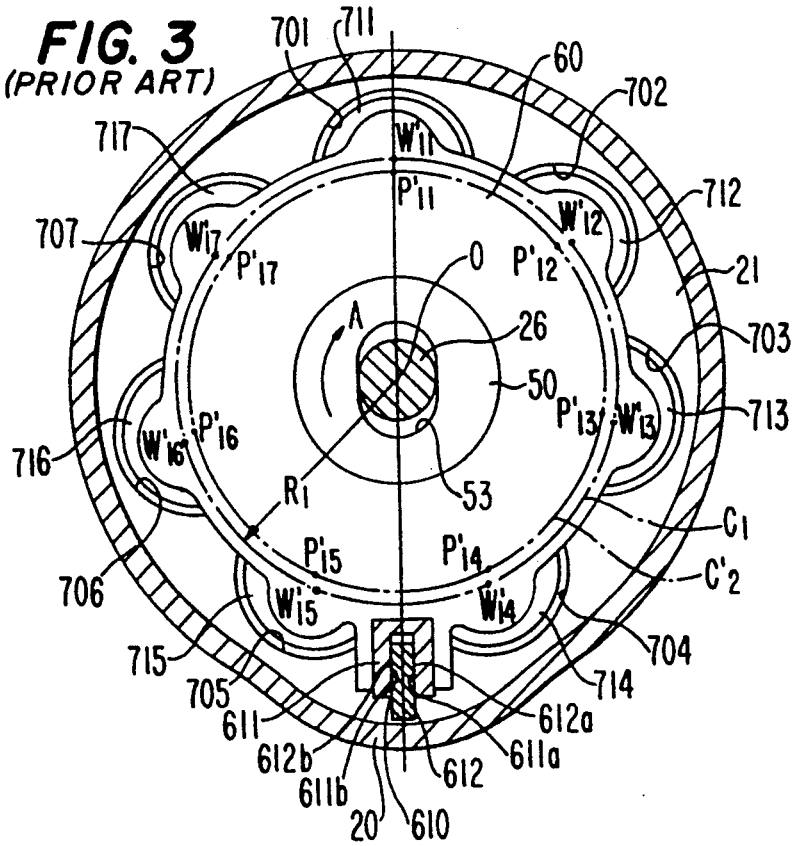
FIG. 3 (PRIOR ART)
FIG. 3 schematically illustrates a vertical transverse sectional view of a wobble plate type refrigerant compressor in accordance with another prior art embodiment. In the drawing, a locational relationship between the ball-and-socket joints provided at a wobble plate and the ball-and-socket joints provided at each of the respective pistons is specifically illustrated.
Figure 6:
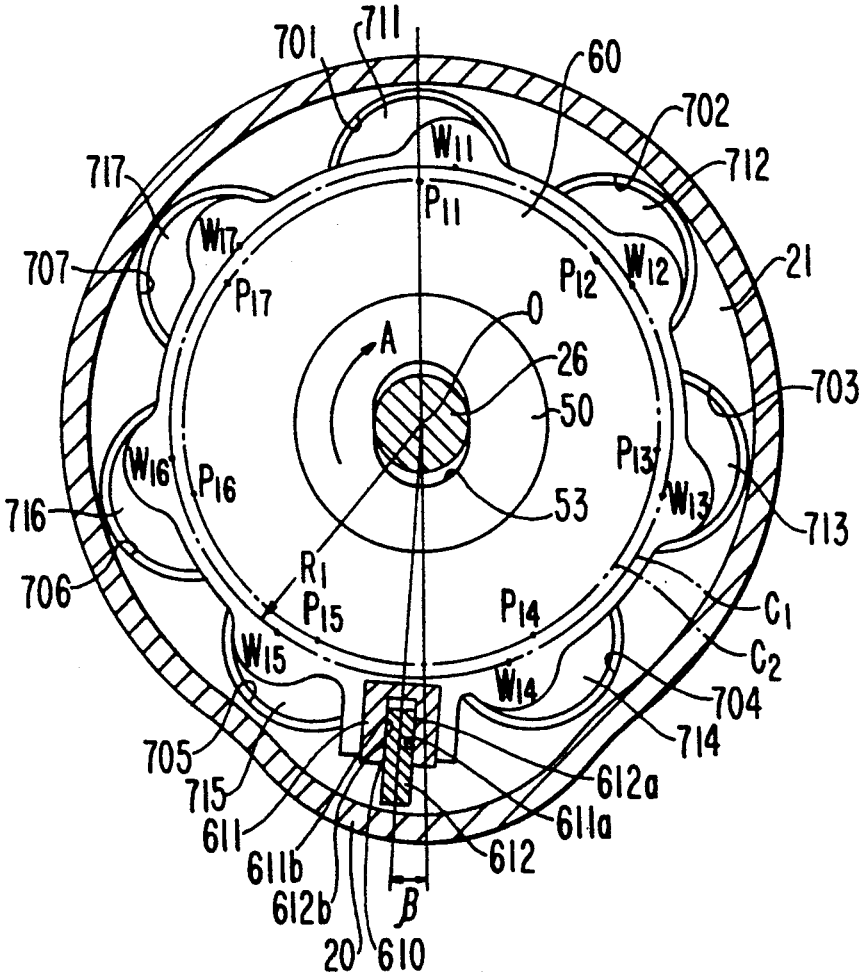
FIG. 6 schematically illustrates a vertical transverse sectional view of a wobble plate type refrigerant compressor in accordance with a second embodiment of the present invention. In the drawing, a locational relationship between the ball-and-socket joints provided at a wobble plate and the ball-and-socket joints provided at each of the respective pistons is specifically illustrated.

FIG. 6 schematically illustrates a vertical transverse sectional view of a wobble plate type refrigerant compressor in accordance with the present invention, as applied to the prior art embodiment of FIG. 3, with like numerals representing corresponding elements as shown in FIGS. 1 and 3. In the drawing, the locational relationship between the equiangular ball-and-socket joints provided at wobble plate 60 and the non-equiangular ball-and-socket joints provided at each of respective pistons 711–717 is specifically illustrated. In the locational relationship between the ball-and-socket joints provided at wobble plate 60 and the ball-and-socket joints provided at each of respective pistons 711–717, this second embodiment is similar to the prior art embodiment of FIG. 3, with the exception of the following matter.

In the second embodiment of the present invention, sliding rail 612 is positioned so as to be radially shifted by angle $\beta$ in the rotational direction "A" of cam rotor 40, with respect to the location at which sliding rail 612 was positioned in the prior art embodiments. Therefore, in the assembling process of the compressor, points $W_{11}$–$W_{17}$ are radially shifted in the rotational direction "A" of cam rotor 40 with respect to points $P_{11}$–$P_{17}$, respectively, by angle $\beta$ (for example, $\pi/60$) when fork-shaped slider 611 is mounted on sliding rail 612. The effect of this embodiment is similar to the effect of the first embodiment, and therefore a detailed explanation thereof is omitted.

Figure 7:
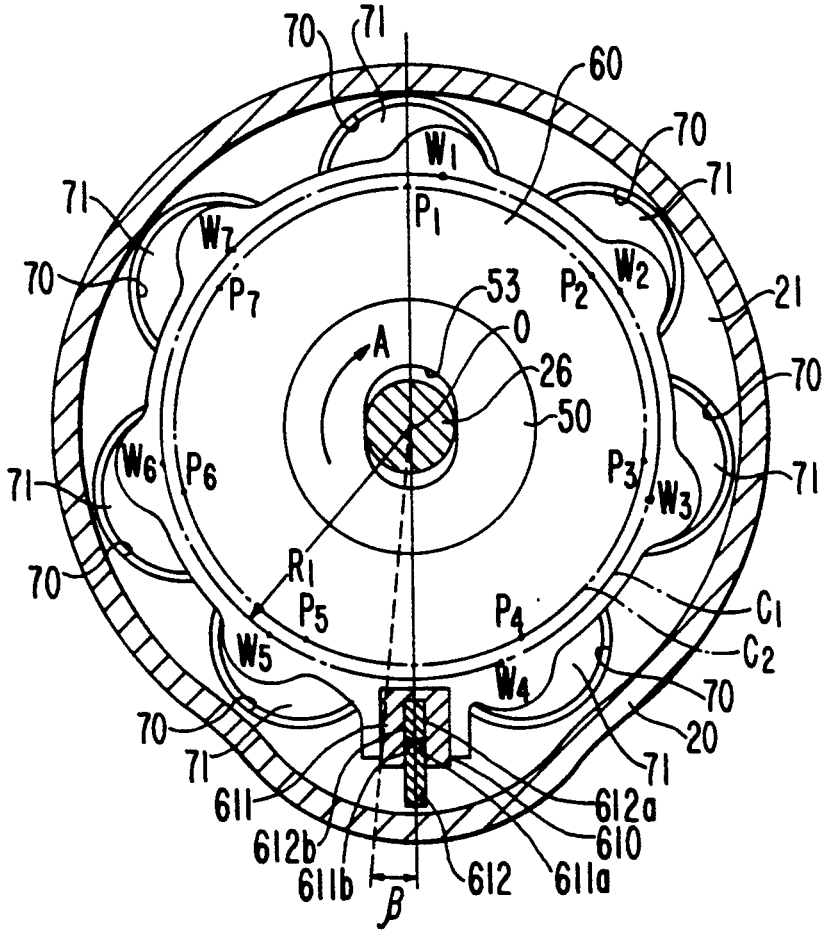
FIG. 7 schematically illustrates a vertical transverse sectional view of a wobble plate type refrigerant compressor in accordance with a third embodiment of the present invention. In the drawing, a locational relationship between the ball-and-socket joints provided at a wobble plate and the ball-and-socket joints provided at each of the respective pistons is specifically illustrated.

In the first and seocnd embodiments of the present invention, sliding rail 612 is positioned so as to be radially shifted in the rotational direction "A" of cam rotor 40, with respect to the location at which sliding rail 612 is positioned in the prior art embodiments of FIGS. 2 and 3. However, FIG. 7 schematically illustrates a third embodiment of the present invention in which the desired result, similar to that obtained in the first and second embodiments of the present invention, can also be produced by shifting slider 611 in the opposite rotational direction of cam rotor 40, that is, opposite to rotational direction "A", while maintaining the location of sliding rail 612 in the position of the prior art embodiments. In this instance, points $W_{11}$–$W_{17}$ are radially shifted in the rotational direction "A" of cam rotor 40 with respect to points $P_{11}$–$P_{17}$, respectively, by angle $\beta$ when fork-shaped slider 611 is mounted on sliding rail 612. This third embodiment is illustrated as applied to the prior art embodiment of FIG. 2, but it could also of course be applied to the prior art embodiment of FIG. 3.

Additionally, although FIG. 1 illustrates a variable capacity wobble plate type compressor, the embodiments of the present invention are of course applicable not only to the variable capacity wobble plate type compressors but to fixed capacity wobble plate type compressors as well.

This invention has been described in connection with the preferred embodiments. These embodiments, however, are merely for example only and the invention is not restricted thereto. It will be understood by those skilled in the art that other variations and modifications can be easily made within the scope of this invention as defined by the appended claims.

I claim:

1. In a wobble plate type compressor comprising a compressor housing having a cylinder block provided with a plurality of cylinders and a crank chamber enclosed within said cylinder block, a piston slidably fitted within each of said cylinders, a drive shaft rotatably supported in said housing, a rotor fixed on said drive shaft and further connected to an inclined plate, a wobble plate rotatably mounted on said inclined plate, a coupling member of coupling said wobble plate with each of said plurality of pistons, said coupling member having one end which is coupled with said wobble plate and another end which is coupled with each of said pistons, and rotation preventing means for preventing rotation of said wobble plate such that rotational motion of said inclined plate is converted into nutational motion of said wobble plate, said rotation preventing means including a guide member axially extending within said crank chamber and a fork-shaped member slidably mounted on said guide, said fork-shaped member attached to an outer peripheral end of said wobble plate, the improvement comprising:

said one end of said coupling member is radially shifted in the rotational direction of said rotor with respect to said other end of said coupling member, by a predetermined angle.

2. The compressor of claim 1 wherein each of said other ends of said couplilng members is located on the longitudinal axis of each of said plurality of cylinders, respectively.

3. The compressor of claim 1 wherein said coupling member is provided with a ball portion at both said one end and said other end thereof so as to form a ball-and-socket joint between said wobble plate and said one end of said coupling member, and each of said pistons and said other end of said coupling member.

4. The compressor of claim 2 wherein each of said one ends of said coupling members is peripherally located on a circle about the longitudinal axis of said wobble plate with an equiangular interval.

5. The compressor of claim 4 wherein said circle comprises a first circle and each of said other ends of said coupling members is peripherally located on a second circle about the longitudinal axis of said rotor with an equiangular interval.

6. The compressor of claim 5 wherein a radius of said first circle is greater than a radius of said second circle.

7. A wobble plate type compressor comprising:

a compressor housing;

a cylinder block defined within said compressor housing;

said cylinder block including a plurality of cylinders;

a crank chamber enclosed within said cylinder block;

a piston slidably fitted within each of said cylinders;

a drive shaft rotatably supported in said housing;

a rotor fixed on said drive shaft;

an inclined plate connected to said rotor;

a wobble plate rotatably mounted on said inclined plate;

a coupling member for coupling said wobble plate with each of said pistons;

said coupling member having one end which is coupled to said wobble plate and another end which is coupled to each of said pistons;

rotation preventing means for preventing rotation of said wobble plate such that the rotational motion of said inclined plate is converted into nutational motion of said wobble plate; and said rotation preventing means including a guide member axially extending within said crank chamber and a fork-shaped member slidably mounted on said guide member, said fork-shaped member attached to an outer peripheral end of said wobble plate;

wherein one of said ends of said coupling member is radially shifted by a predetermined angle in the rotational direction of said rotor, with respect to said other end of said coupling member.

8. The compressor of claim 7 wherein said end of said coupling member that is radially shifted is coupled to said wobble plate and said other end of said coupling member is located on the longitudinal axis of each of said plurality of cylinders, respectively.

9. The compressor of claim 7 wherein said coupling member is provided with a ball portion at both of said ends thereof so as to form a ball-and-socket joint between said wobble plate and said one end of said coupling member and between each of said pistons and said other end of said coupling member.

10. The compressor of claim 8 wherein said ends of said coupling member that are radially shifted are peripherally located on a circle about the longitudinal axis of said wobble plate with an equiangular interval.

11. The compressor of claim 10 wherein said circle comprises a first circle and said other ends of said coupling members are peripherally located on a second circle about the longitudinal axis of said rotor with an equiangular interval.

12. The compressor of claim 11 wherein a radius of said first circle is greater than a radius of said second circle.

13. A wobble plate type compressor comprising:

a compressor housing;

a cylinder block defined within said compressor housing;

said cylinder block including a plurality of cylinders;

a crank chamber enclosed within said cylinder block;

a piston slidably fitted within each of said cylinders;

a drive shaft rotatably supported in said housing;

a rotor fixed on said drive shaft and further connected to an inclined plate;

a wobble plate rotatably mounted on said inclined plate;

a coupling member for coupling said wobble plate with each of said plurality of pistons;

said coupling member having one end which is coupled to said wobble plate and another end which is coupled to each of said plurality of pistons;

rotation preventing means for preventing rotation of said wobble plate such that rotational motion of said inclined plate is converted into nutational motion of said wobble plate; and said rotation preventing means including a sliding rail guide member axially extending within said crank chamber and a fork-shaped slider member slidably mounted on said guide member, said fork-shaped member attached to an outer peripheral end of said wobble plate;

a center axis having a centerpoint which intersects the longitudinal axis of said driveshaft, said center axis defined when an axis is passed through the centers of said end of said coupling member that is coupled to said wobble plate and said end of said coupling member which is coupled to one of said plurality of pistons, when the centers are radially alilgned, and through the center of said rotation prevention means when it is aligned in a vertical plane therewith; and wherein said sliding rail guide is radially shifted with respect to said center axis of said compressor by a predetermined angle in the direction of the rotation of said rotor, such that the center of said end of said coupling member that is coupled to said wobble plate is radially shifted in the direction of rotation of said rotor with respect to the center of said end of said coupling member which is coupled to one of said pistons.

14. The compressor of claim 13 wherein each of said ends of said plurality of coupling members which is coupled to said wobble plate is peripherally located about the longitudinal axis of said wobble plate with an equiangular interval and thereby defines a wobble plate circle.

15. The compressor of claim 14 wherein each of said ends of said plurality of coupling members that is coupled to one of said pistons is peripherally located about the longitudinal axis of said drive shaft with an equiangular interval and thereby defines a piston circle.

16. The compressor of claim 15 wherein a radius of said wobble plate circle is greater than a radius of said piston circle.

17. The compressor of claim 14 wherein each of said ends of said plurality of coupling members that is coupled to one of said plurality of pistons is peripherally located about the longitudinal axis of said drive shaft with a non-equiangular interval and thereby defines a non-equiangular piston circle.

18. The compressor of claim 17 wherein a radius of said wobble plate circle is greater than a radius of said non-equiangular piston circle.

19. A wobble plate type compressor comprising:

a compressor housing;

a cylinder block defined within said compressor housing;

said cylinder block including a plurality of cylinders;

a crank chamber enclosed within said cylinder block;

a piston slidably fitted within each of said cylinders;

a drive shaft rotatably supported in said housing;

a rotor fixed on said drive shaft and further connected to an inclined plate;

a wobble plate rotatably mounted on said inclined plate;

a coupling member for coupling said wobble plate with each of said plurality of pistons;

said coupling member having one end which is coupled to said wobble plate and another end which is coupled to each of said plurality of pistons;

rotation preventing means for preventing rotation of said wobble plate such that rotational motion of said inclined plate is converted into nutational motion of said wobble plate; and said rotation preventing means including a sliding rail guide member axially extending within said crank chamber and a fork-shaped slider member slidably mounted on said guide member, said fork-shaped member attached to an outer peripheral end of said wobble plate;

a center axis having a centerpoint which intersects the longitudinal axis of said driveshaft, said center axis defined when an axis is passed through the centers of said end of said coupling member that is coupled to said wobble plate and said end of said coupling member which is coupled to one of said plurality of pistons, when the centers are radially aligned, and through the center of said rotation prevention means when it is aligned in a vertical plane therewith; and wherein said fork-shaped slider member is radially shifted with respect to said center axis of said compressor by a predetermined angle in a direction opposite to the rotational direction of said rotor.

20. The compressor of claim 19 wherein each of said ends of said coupling member that is coupled to said wobble plate is radially shifted by the predetermined angle with respect to each of said ends of said coupling member which is coupled to one of said pistons, respectively.

* * * * *